US010992090B2

(12) United States Patent
Zhou et al.

(10) Patent No.: US 10,992,090 B2
(45) Date of Patent: Apr. 27, 2021

(54) CABLE CONNECTOR ASSEMBLY HAVING TWO PLUGS FOR PROVIDING A SECURE CONNECTION

(71) Applicant: Yong Tai Electronic(DONGGUAN) Ltd., Dongguan (CN)

(72) Inventors: Shi-Hai Zhou, Dongguan (CN); Yu-Sheng Li, Dongguan (CN)

(73) Assignee: YONG TAI ELECTRONIC(DONGGUAN) LTD., Dongguan (CN)

( * ) Notice: Subject to any disclaimer, the term of this patent is extended or adjusted under 35 U.S.C. 154(b) by 43 days.

(21) Appl. No.: 16/511,034

(22) Filed: Jul. 15, 2019

(65) Prior Publication Data

US 2020/0083653 A1 Mar. 12, 2020

(30) Foreign Application Priority Data

Sep. 12, 2018 (CN) ..... 201811061753.8

(51) Int. Cl.

| | |
|---|---|
| ***H01R 13/04*** | (2006.01) |
| ***H01R 25/00*** | (2006.01) |
| ***H01R 13/504*** | (2006.01) |
| ***H01R 13/66*** | (2006.01) |
| ***H01R 43/20*** | (2006.01) |

(52) U.S. Cl.

CPC ..... *H01R 25/003* (2013.01); *H01R 13/504* (2013.01); *H01R 13/665* (2013.01); *H01R 43/205* (2013.01)

(58) Field of Classification Search

CPC .... H01R 25/003; H01R 43/205; H01R 27/02; H01R 13/504; H01R 13/443; H01R 13/665

USPC ..... 439/694, 148, 528

See application file for complete search history.

(56) References Cited

U.S. PATENT DOCUMENTS

| | | | | |
|---|---|---|---|---|
| 7,029,335 | B2 * | 4/2006 | Osada | H01R 13/447 439/466 |
| 9,692,187 | B2 * | 6/2017 | Qian | H01R 13/665 |
| 2004/0029444 | A1 * | 2/2004 | Tang | H01R 13/659 439/607.58 |
| 2012/0214326 | A1 * | 8/2012 | Ko | G02B 6/3817 439/345 |
| 2019/0058279 | A1 * | 2/2019 | Wu | H01R 27/02 |
| 2019/0356078 | A1 * | 11/2019 | Li | H01R 12/707 |
| 2020/0081860 | A1 * | 3/2020 | Abdul-Razzak | H01R 13/6205 |

* cited by examiner

*Primary Examiner* — Hae Moon Hyeon
(74) *Attorney, Agent, or Firm* — WPAT, PC

(57) ABSTRACT

The invention discloses a cable connector assembly and method for manufacturing the same, the cable connector assembly includes a cable; a first connector and a second connector, the first connector includes a first plug, the first plug is inserted in the first port, the first plug is electrically connecting the cable via a printed circuit board; the second connector includes a second plug, the second plug is inserted in the second port, the second connector is assembled onto the first connector, the second plug is not electrically connecting with the second port. The second connector is assembled onto the first connector, therefore, the second connector plays the function of fixing the first connector, the cable connector assembly is less likely to be shaken or loosened during use, and the electrical connection between the first connector and the first port is more stable.

10 Claims, 7 Drawing Sheets

CABLE CONNECTOR ASSEMBLY HAVING TWO PLUGS FOR PROVIDING A SECURE CONNECTION

CROSS REFERENCE TO PRIORITY APPLICATIONS

This application claims the priority to Chinese Application 201811061753.8 for a cable connector assembly and method for manufacturing the same (filed Sep. 12, 2018 at the China National Intellectual Property Administration, CNIPA). The disclosures of the above application is incorporated herein by reference in its entirety.

FIELD OF THE INVENTION

The invention pertains to a cable connector assembly and method for manufacturing the same.

BACKGROUND OF THE INVENTION

Cable connectors are widely used for signal transmission between electronic devices. Cable connectors typically include a plug and a cable, the plug is used to mate with an external electronic device for electrical connection. Most of the existing external electronic devices are provided with a plurality of interfaces for plugging in the cable connectors. As there are multiple interfaces, if a plug is plugged into one interface in separately, it is easily affected by external forces and loosened from the corresponding interface. The data transmission is interrupted, which brings great trouble to the users.

Therefore, there is a need to design a new cable connector and a method of manufacturing the same to overcome the above shortcomings.

SUMMARY OF THE INVENTION

The purpose of the invention is to provide a cable connector assembly with stable electrical connection and method for manufacturing the same.

In accordance with an aspect of the embodiment, there is provided a cable connector assembly, the cable connector assembly is used for electrically connecting with an external device, the external device includes a first port and a second port, the first port and the second port are arranged side by side, comprising: a cable; a first connector, the first connector includes a first plug, the first plug is inserted in the first port, the first plug is electrically connecting the cable via a printed circuit board; a second connector, the second connector includes a second plug, the second plug is inserted in the second port, the second connector is assembled onto the first connector, the second plug is not electrically connecting with the second port.

In accordance with an aspect of the embodiment, there is provided a method for manufacturing the above cable connector assembly, the method comprising:

a. providing a first connector and a cable, the first connector includes a first plug and a printed circuit board, the first plug and the cable are electrically connecting to the printed circuit board;
b. providing a first inner casing, the first inner casing is insert molded in the front of the cable, the periphery of the printed circuit board and the end of the first plug;
c. insert molding a first outer casing onto the periphery of the first inner casing;

d. providing a second connecter, the second connector is assembled onto the first outer casing along the direction as the cable extends.

The invention has the followings advantages:

The second connector is assembled onto the first connector, the second plug is inserted into the second port but not electrically connected to the second port, therefore, the second connector plays the function of fixing the first connector, the cable connector assembly is less likely to be shaken or loosened during use, and the electrical connection between the first connector and the first port (not figured) is more stable.

BRIEF DESCRIPTION OF THE DRAWINGS

The invention will be described with reference to the accompanying drawings. These and/or other aspects and advantages of the invention will become apparent and more readily appreciated from the following description of the embodiments, taken in conjunction with the accompanying drawings.

DETAILED DESCRIPTION OF THE INVENTION

The invention will be further described below in details with reference to the figures and embodiments.

Figure 1:
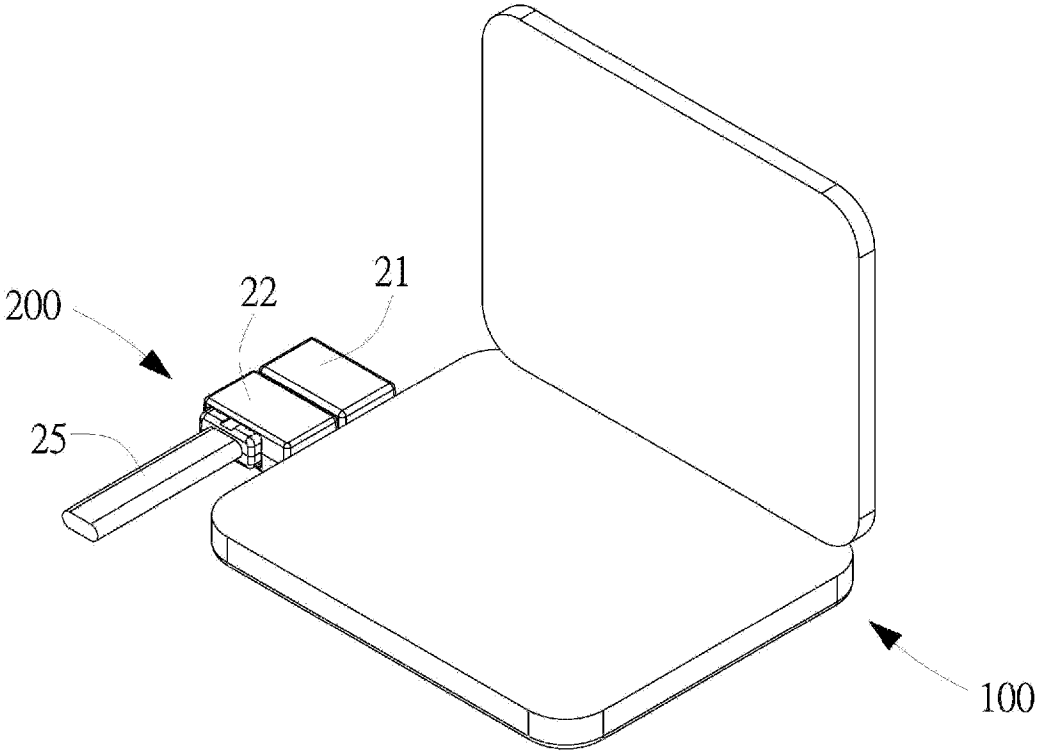
FIG. 1 is a perspective view of the cable connector assembly and the external device according to one embodiment of the present invention.

As shown in FIG. 1, the cable connector assembly 200 is electrically connecting with an external device 100, the external device 100 includes a first port (not figured) and a second port (not figured).

Figure 2:
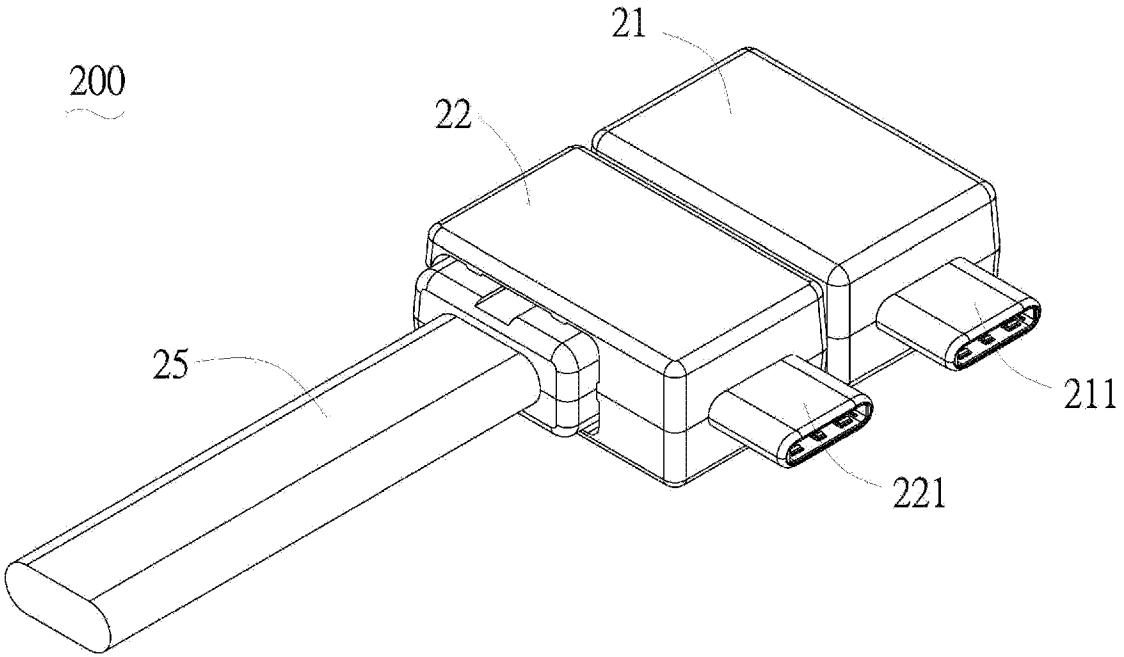
FIG. 2 is a perspective view of the cable connector assembly according to one embodiment of the present invention.
Figure 3:
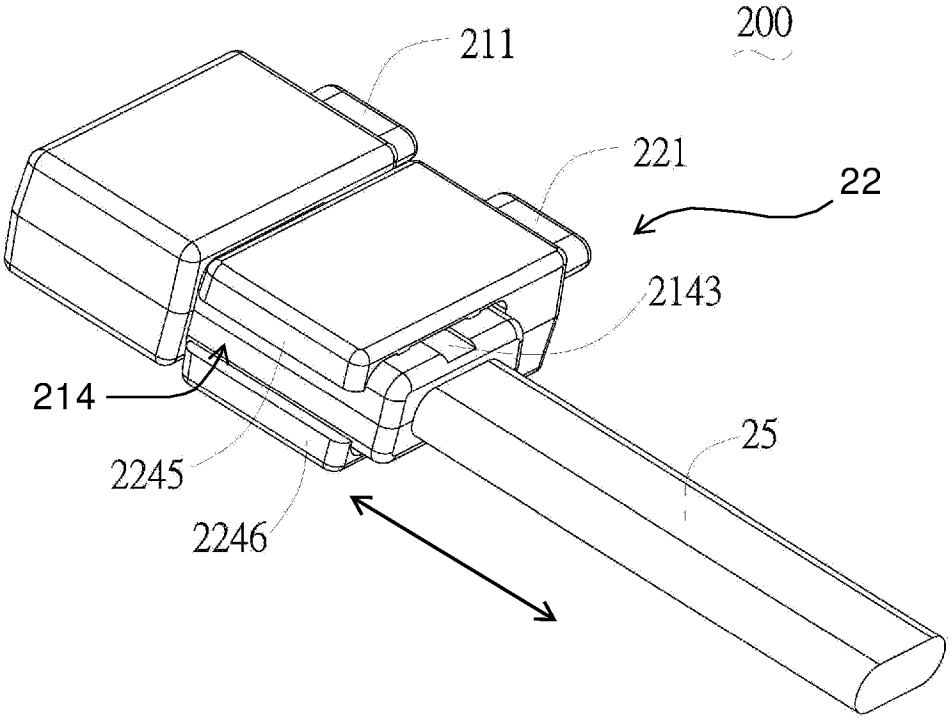
FIG. 3 is a perspective view of the cable connector assembly viewed from another direction.
Figure 4:
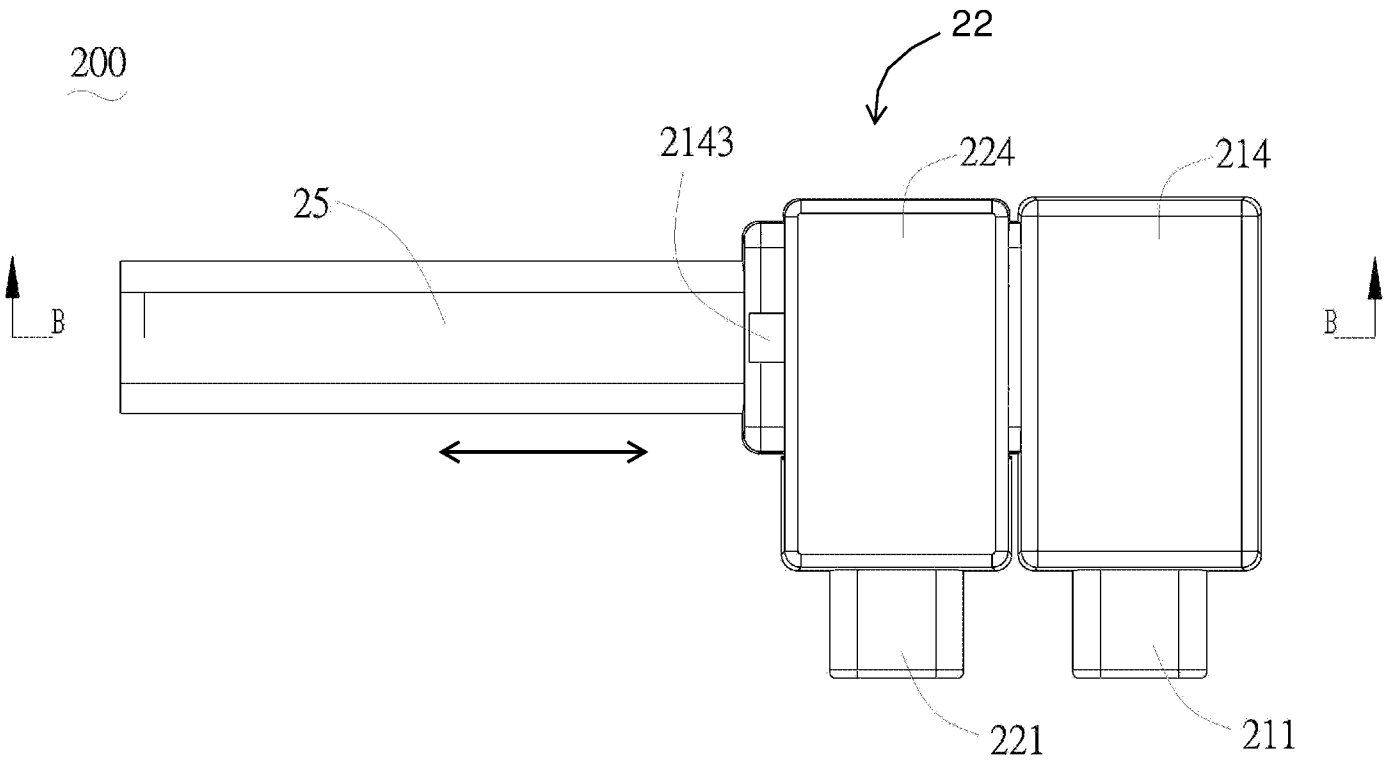
FIG. 4 is a top view of the cable connector assembly according to one embodiment of the present invention.
Figure 5:
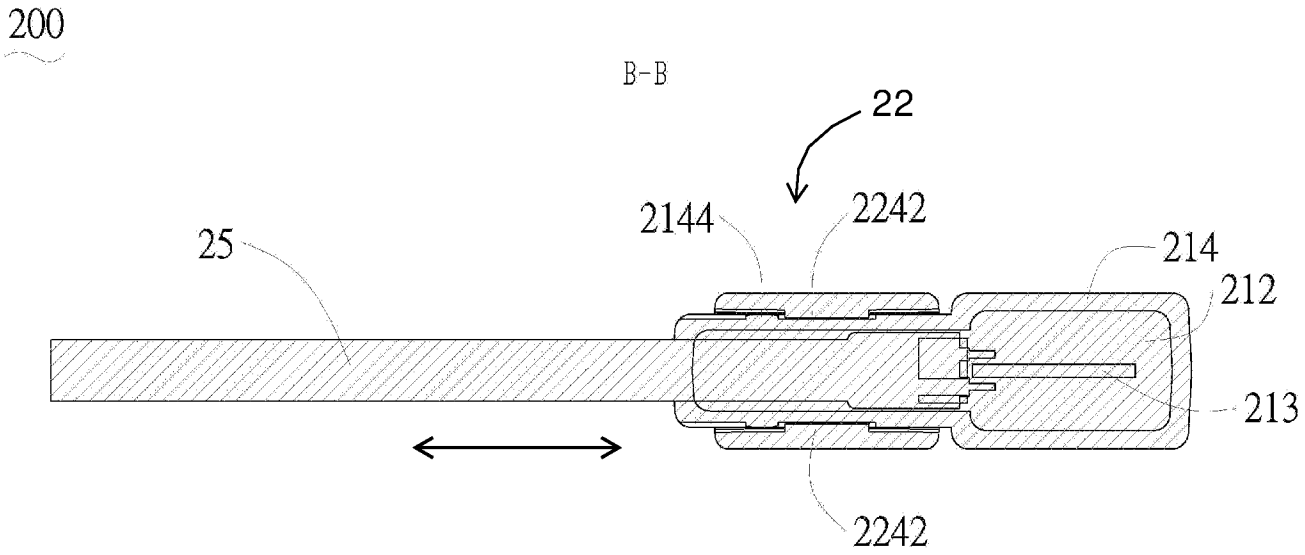
FIG. 5 is a cross-sectional view of the cable connector assembly of the present invention viewed from B-B direction.

Referring generally to FIGS. 2 and 3, the cable connector assembly 200 includes a first connector 21, a second connector 22 and a cable 25.

Figure 6:
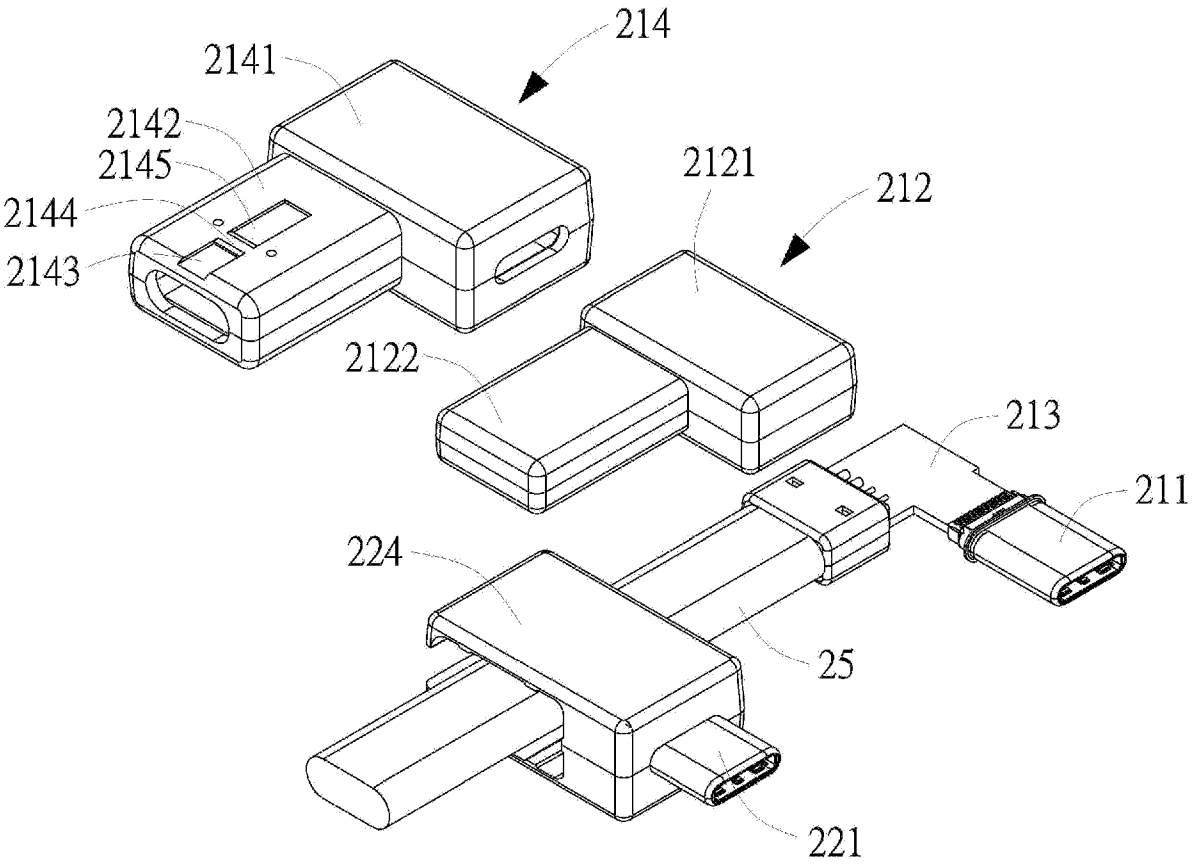
FIG. 6 is a perspective exploded view of the cable connector assembly of the present invention.
Figure 7:
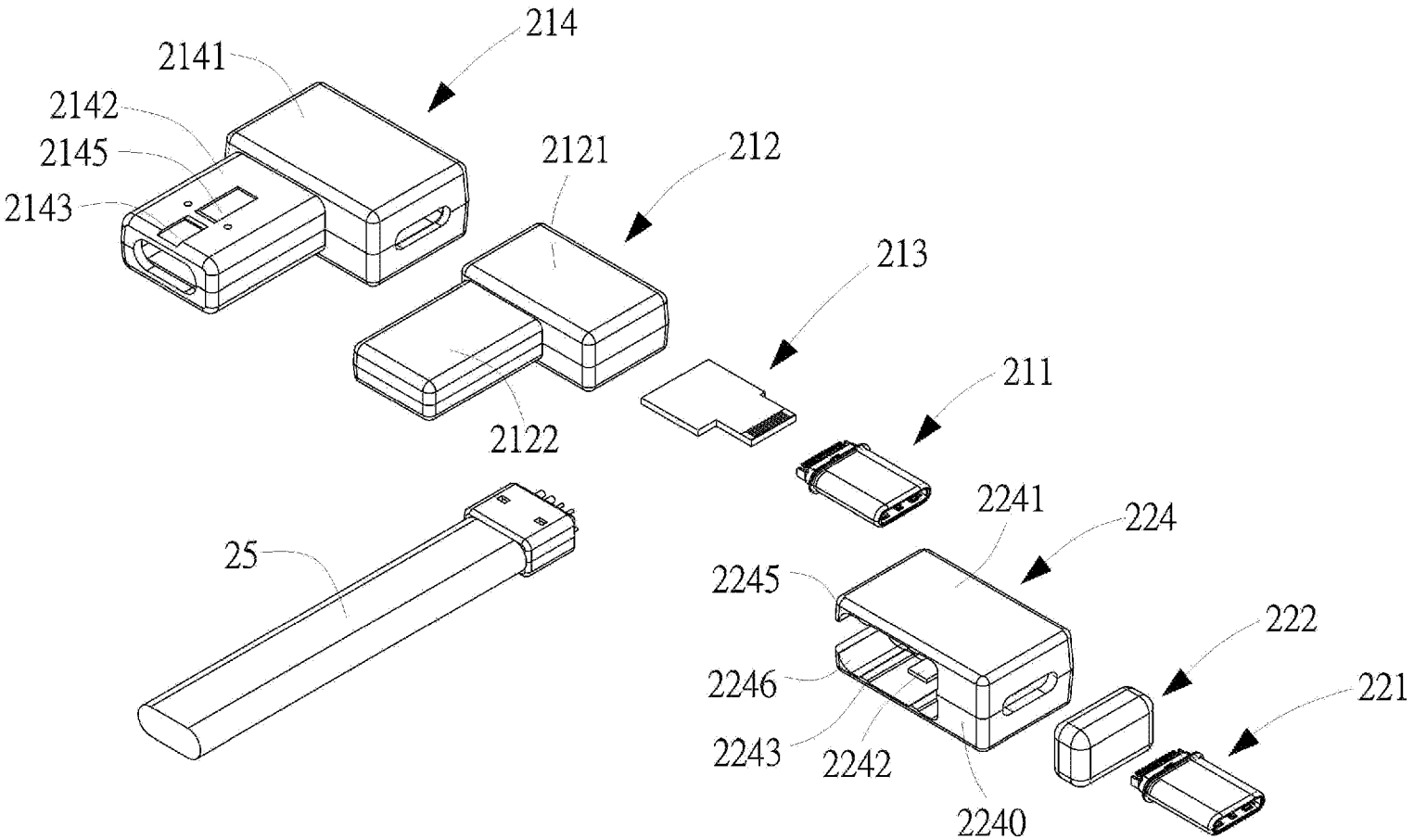
FIG. 7 is a further perspective exploded view of the cable connector assembly of the present invention.

Referring generally to FIGS. 6 and 7, the first connector 21 of the cable connector assembly 200 according to the present invention includes a first plug 211, a printed circuit board 213, a first inner casing 212 and a first outer casing 214. The first inner casing 212 is insert molded with the first plug 211, the first outer casing 214 is inserted molded on the periphery of the first inner casing 212.

The first plug 211 is electrically connected to the first port (not figured), the first plug 211 is electrically connected to the cable 25 via the printed circuit board 213. The first plug 211 extends perpendicularly to the direction of the cable 25, and the insertion direction of the first plug 211 is also perpendicular to the direction of the cable 25.

The first outer casing 214 includes a first positioning portion 2142 and a first mating portion 2141 connecting with the first positioning portion 2142. The first positioning portion 2142 extends in the direction of the cable 25, the first mating portion 2141 extends perpendicularly to the direction of the cable 25.

A first recess 2143 and a second recess 2145 are defined on the periphery of the first outer casing 214. In the embodiment, the first recess 2143 and the second recess 2145 are defined on the top surface of the first positioning portion 2142 and the bottom surface of the first positioning portion 2142. A partition 2144 is defined between the first recess 2143 and the second recess 2145. In other embodiments, alternatively, the first recess 2143 and the second recess 2145 are defined on the top surface of the first positioning portion 2142 or the bottom surface of the first positioning portion 2142.

The first inner casing 212 includes a second positioning portion 2122 and a second mating portion 2121 connecting with the second positioning portion 2122. The second positioning portion 2122 extends in the direction of the cable 25, the second mating portion 2121 extends perpendicularly to the direction of the cable 25.

The second connector 22 of the cable connector assembly 200 in the present invention is assembled onto the first connector 21, the second connector 22 includes a second plug 221, a second inner casing 222 and a second outer casing 224. In the embodiment, the first plug 211 and the second plug 221 conform with the same specification, the second inner casing 222 is insert molded with the second plug 221, the second outer casing 224 is inserted molded on the periphery of the second inner casing 222, an assembly space (not figured) is defined in the second outer casing 224, the cable 25 and the first outer casing 214 pass through the assembly space (not figured) so as to position the second connector 22 onto the first connector 21.

The second connector 22 is inserted into the second port (not figured), the second connector 22 is assembled onto the first connector 21, the second plug 221 is not electrically connected to the second port (not figured). The second connector 22 is assembled onto the first connector 21, and the second connector 22 is inserted to the second port (not figured), therefore, the second connector 22 plays the function of fixing the first connector 21, and the cable connector assembly 200 of the present invention is less likely to be shaken or loosened during use, and the electrical connection between the first connector 21 and the first port (not figured) is more stable.

Referring generally to FIGS. 6 and 7, the top surface of the first outer casing 214 and the top surface of the second outer casing 224 are substantially on the same level, the bottom surface of the first outer casing 214 and the bottom surface of the second outer casing 224 are substantially on the same level. The second outer casing 224 includes a base 2240, a first plate 2241 and a second plate 2243, the first plate 2241 extends from the base 2240, the second plate 2243 is opposite to the first plate 2241, the assembly space (not figured) is defined between the first plate 2241 and the second plate 2243. At least one buckling portion 2242 is defined on the inner wall of the first plate 2241 and/or the second plate 2243, the buckling portion 2242 spans along the first recess 2143 and traverses the partition 2144 to enter the second recess 2145. In the embodiment, the buckling portion 2242 is respectively defined on the inner wall of the first plate 2241 and that of the second plate 2243, the buckling portion 2242 on the first plate 2241 corresponds to the first recess 2143 on the top surface of the positioning portion 2142, the buckling portion 2242 on the first plate 2241 corresponds to the second recess 2145 on the bottom of the positioning portion 2142.

In the embodiment, a first limiting portion 2245 is formed extending from the first plate 2241 towards the direction of the second plate 2243, a second limiting portion 2246 is formed extending from the second plate 2243 towards the direction of the first plate 2241, the first limiting portion 2245 and the second limiting portion 2246 lean against a lateral side of the first outer casing 214. The first limiting portion 2245 and the second limiting portion 2246 are substantially on the same level as one lateral side of the first mating portion 2141.

The invention also provides a method for manufacturing above-mentioned cable connector assembly 200, including the following steps:

1) providing a first connector 21 and a cable 25, the first connector includes a first plug 211 and a printed circuit board 213, the first plug 211 and the cable 25 are electrically connecting to the printed circuit board 213;
2) providing a first inner casing 212, the first inner casing 212 is insert molded in the front of the cable 25, the periphery of the printed circuit board 213 and the end of the first plug 211;
3) insert molding a first outer casing 214 onto the periphery of the first inner casing 212;
4) providing a second connecter 22, the second connector 22 is assembled onto the first outer casing 214 along the direction as the cable 25 extends, the buckling portion 2242 spans along the first recess 2143 and traverses the partition 2144 to enter the second recess 2145, and thus the second connector 22 is assembled onto the first connector 21

The second connector 22 of the cable connector assembly 200 according to the present invention is assembled onto the first connector 21, the second plug 22 is not electrically connected to the second port (not figured). The second connector 22 is assembled onto the first connector 21, and the second connector 22 is inserted to the second port (not figured), therefore, the second connector 22 plays the function of fixing the first connector 21, and the cable connector assembly 200 of the present invention is less likely to be shaken or loosened during use, and the electrical connection between the first connector 21 and the first port (not figured) is more stable.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cable connector assembly, used for electrically connecting with an external device, the external device includes a first port and a second port, the first port and the second port are arranged side by side, comprising:

a cable;

a first connector, the first connector includes a first plug, the first plug is inserted in the first port, the first plug is electrically connecting the cable via a printed circuit board;

a second connector, the second connector includes a second plug, the second plug is inserted in the second port, the second connector is assembled onto the first connector, the second plug is not electrically connecting with the second port.

2. The cable connector assembly as defined in claim 1, wherein the first connector further includes a first inner casing and a first outer casing, the first inner casing is insert molded with the first plug, the first outer casing is insert molded on the periphery of the first inner casing, the first outer casing includes a first positioning portion and a first mating portion connecting with the first positioning portion, the first positioning portion extends in the direction of the cable, the first mating portion extends perpendicularly to the direction of the cable.

3. The cable connector assembly as defined in claim 2, wherein the second connector further includes a second inner casing and a second outer casing, the second inner casing is insert molded with the second plug, the second outer casing is insert molded on the periphery of the second inner casing, an assembly space is defined in the second outer casing, the cable and the first outer casing pass through the assembly space so as to position the second connector onto the first connector.

4. The cable connector assembly as defined in claim 3, wherein a first recess and a second recess are defined on the top surface and/or the bottom surface of the first positioning portion, a partition is defined between the first recess and the second recess.

5. The cable connector assembly as defined in claim 4, wherein the second outer casing includes a base, a first plate and a second plate, the first plate extends from the base, the second plate is opposite to the first plate, the assembly space is defined between the first plate and the second plate, at least one buckling portion is defined on an inner wall of the first plate and/or the second plate, the buckling portion spans along the first recess and traverses the partition to enter the second recess.

6. The cable connector assembly as defined in claim 5, wherein a first limiting portion is formed extending from the first plate towards the direction of the second plate, a second limiting portion is formed extending from the second plate towards the direction of the first plate, the first limiting portion and the second limiting portion lean against a lateral side of the first outer casing.

7. The cable connector assembly as defined in claim 1, wherein the first plug extends along a first direction, the cable extends along a second direction, the first direction is perpendicular to the second direction.

8. A method for manufacturing a cable connector assembly, the method comprising:

a. providing a first connector and a cable, the first connector includes a first plug and a printed circuit board, the first plug and the cable are electrically connecting to the printed circuit board;

b. providing a first inner casing, the first inner casing is insert molded in a front of the cable, the periphery of the printed circuit board and an end of the first plug;

c. insert molding a first outer casing onto a periphery of the first inner casing;

d. providing a second connecter, the second connector is assembled onto the first outer casing along the direction as the cable extends.

9. The method as defined in claim 8, wherein the second connector further includes a second inner casing and a second outer casing, the second inner casing is insert molded with the second plug, the second outer casing is insert molded on the periphery of the second inner casing.

10. The method as defined in claim 9, wherein a first recess and a second recess are defined on the periphery of the first outer casing, a partition is defined between the first recess and the second recess, at least one buckling portion is defined on the inner wall of the second outer casing, the buckling portion spans along the first recess and traverses the partition to enter the second recess.

* * * * *